United States Patent [19]

Nixon

[11] Patent Number: 4,626,810

[45] Date of Patent: Dec. 2, 1986

[54] LOW ATTENUATION HIGH FREQUENCY COAXIAL CABLE FOR MICROWAVE ENERGY IN THE GIGAHERTZ FREQUENCY RANGE

[76] Inventor: Arthur C. Nixon, 2065 Smithtown Ave., Ronkonkoma, Long Island, N.Y. 11779

[21] Appl. No.: 657,005

[22] Filed: Oct. 2, 1984

[51] Int. Cl.[4] ..... H01P 3/06

[52] U.S. Cl. ..... 333/243; 174/110 F; 174/110 FC; 174/120 R; 156/244.11

[58] Field of Search ..... 333/236, 243, 244, 245; 174/110 F, 110 FC, 120 R

[56] References Cited

U.S. PATENT DOCUMENTS

| | | | |
|---|---|---|---|
| 3,054,710 | 9/1962 | Nixon | 174/110 FC X |
| 3,852,518 | 12/1974 | Wargotz et al. | 174/120 R X |
| 4,346,253 | 8/1982 | Saito et al. | 333/243 X |
| 4,382,236 | 5/1983 | Suzuki | 333/236 X |
| 4,408,089 | 10/1983 | Nixon | 333/243 X |
| 4,529,564 | 7/1985 | Harlow | 174/110 FC X |

*Primary Examiner*—Paul Gensler

*Attorney, Agent, or Firm*—Parmelee, Bollinger & Bramblett

[57] ABSTRACT

A low attenuation high frequency coaxial cable is provided for carrying microwave energy in the gigaHertz range. A center conductor is wrapped with a plurality of layers of low density PTFE dielectric material. At least one layer of high density unsintered PTFE dielectric material is tightly wrapped around the low density tape with overlapping edges and then is sintered for forming an envelope strong enough to hold the low density material in position during the remainder of the cable preparation and during an attaching of terminating connectors. An outer conductor of longitudinally extending, parallel, adjacent electrically conductive wire strands is applied with a slight helical lay around the dielectric of the cable along its axis thereof surrounding the high density tape. A serving may be applied over the longitudinal wire strands and a jacket applied around the cable over the serving. The cable so formed provides an improvement in performance. After heat curing of the cable, it may be improved further by providing a tight wire braid around the jacket which again is provided with another outer jacket. The serving may be omitted, and then the jacket of unsintered high density PTFE is applied around the wire strands of the outer conductor. This jacket is sintered, and then a wire braid is applied tightly over the sintered jacket.

17 Claims, 4 Drawing Figures

LOW ATTENUATION HIGH FREQUENCY COAXIAL CABLE FOR MICROWAVE ENERGY IN THE GIGAHERTZ FREQUENCY RANGE

BACKGROUND OF THE INVENTION

This invention relates to coaxial electrical cables, and more particularly, to flexible coaxial cables for carrying microwave signals in the gigaHertz range with extremely low attenuation and low radiation losses.

In conventional coaxial cables, a center conductor is surrounded by a dielectric which in turn is surrounded by an outer conductive shield serving as an outer conductor generally coaxial with the center conductor. This outer shield is conventionally formed by a braid of electrical wires and in some cables a second braided shield surrounds the first and the composite is called a double shield braid. Such conventional cables have been found suitable for most applications but are totally unsuited for the very highest frequency applications, for example, in the gigaHertz range, because the attenuation losses of such conventional coaxial cables often are totally unacceptable for use in the gigaHertz (GHz) applications.

Among other problems with these conventional braid shielded coaxial cables are that the braid itself provides windows or openings through which electrical energy leaks or radiates from the cable. This occurs even if multiple braids or layers are employed because the radiation travels between the layers and leaks out through the windows in the outer braid. Also, the flexing of the cable at very high frequencies tends to generate "noise" by the rubbing contact between braids.

In U.S. Pat. No. 4,408,089 of my father the aforesaid problems were addressed in the form of an extremely low attenuation low radiation loss flexible coaxial cable for handling microwave energy in the GHz frequency range. In that patent a flexible dielectric medium which covered a center conductor was surrounded by a plurality of longitudinal, parallel, contiguous conductive strands with a slight helical lay which in turn were surrounded by means to hold them in place, including an outer jacket of flexible impermeable material such as plastic. The coaxial cable of that patent provides superior performance with respect to attenuation loss, leakage, and other properties as compared with conventional braided coaxial cables for microwave work.

The dielectric utilized in the aforesaid patented coaxial cable was a high density PTFE (polytetrafluroethylene).

It would be desirable to use low density dielectric material containing many tiny air pockets filling the region between the central conductor and outer conductor in order to further reduce the attenuation loss. In the GHz range such low density PTFE dielectric exhibits lower losses than high density solid PTFE material. However, low density dielectric is very difficult to use where the accurate terminations are required, because of its own mechanical unstability. This low density dielectric is both "mushy" and "springy", making it difficult to trim accurately in preparation for the attachment of a connector to the end of the cable. Accordingly, using the low density PTFE material for the dielectric causes a severe problem when the shield is removed because no retaining force remains to hold the dielectric in shape. Accordingly, attempting to make an external connection to such a cable becomes a frustrating, unmanageable, unpredictable task, which often ends in failure.

SUMMARY OF THE INVENTION

Accordingly, it is an object of this invention to provide a new and improved low attenuation and low radiation loss flexible coaxial cable for use in handling microwave energy in the GHz frequency range.

Another object of this invention is to provide a new and improved triaxial cable and a method for making the same which reduces the attenuation loss of the cable and is an improvement over the coaxial version.

In carrying out this invention in one illustrative embodiment thereof, a low attenuation, low radiation loss, flexible, high frequency coaxial cable for carring microwave energy in the GHz frequency range is provided with a center conductor extending along the axis of the cable which is covered with a plurality of layers of low density PTFE dielectric material. This low density PTFE dielectric material is covered by at least one layer of high density PTFE dielectric material which in turn is covered with a plurality of longitudinally extending parallel, adjacent conductive wires which are in electrical contact with each other surrounding and forming a first shield around the layer of high density PTFE dielectric material which shield has a slight helical lay along the axis of the cable. A serving of strong material may surround and hold the shield in place and a jacket is positioned over the serving. The triaxial version includes in addition a tight wire braid mounted around the outer jacket for holding the conductive wires of the first shield in place around the high density PTFE dielectric material thereby reducing the cable losses. In this triaxial version the serving may be omitted, and the jacket is high density unsintered (uncured) PTFE. It is sintered (cured) before the tight braid is applied. It is optimum to omit the serving, because such omission provides a reduction in over-all diameter and a reduction in weight per unit length.

Among the many advantages of this invention are that the dielectric material surrounding the central core conductor has a specific gravity of 0.7 and a dielectric constant at 1.45 as contrasted with the high density of dielectric material previously used having a specific gravity of 2 and a dielectric constant of 2.1. Surrounding the low density PTFE dielectric with a very thin layer of high density PTFE dielectric holds the low density dielectric in place and provides both mechanical support and restraint for the underlying low density material during the manufacturing process as well as when the cable is cut and connections are made thereto. By adding an additional overlying or superimposed shield to convert the coaxial cable into a triaxial cable, a remarkable attenuation loss reduction is obtained, from 42 deciBels (dB) per 100 feet down to 35 dB per 100 feet at 18 gigaHertz.

BRIEF DESCRIPTION OF THE DRAWINGS

The invention, together with further objects, features, advantages and aspects thereof will be more clearly understood from the following description taken in conjunction with the accompanying drawings which are not necessarily drawn to scale with the emphasis instead being placed upon clearly illustrating the principles of the invention.

DESCRIPTION OF THE PREFERRED EMBODIMENTS

It should be pointed out that in normal parlance a coaxial cable is one having a central conductor surrounded by dielectric which is encased by an outer conductive shield which represents the return conductor of the cable. The regular coaxial cable having an additional overlying or superimposed shield that is insulated from the first shield may at times be referred to as a "triaxial cable", but it will be understood that the term "coaxial cable" appearing in the claims or in other portions of the specification is intended to be generic and to include such microwave cables having a single shield or having a plurality of shields insulated from each other.

Figure 1:
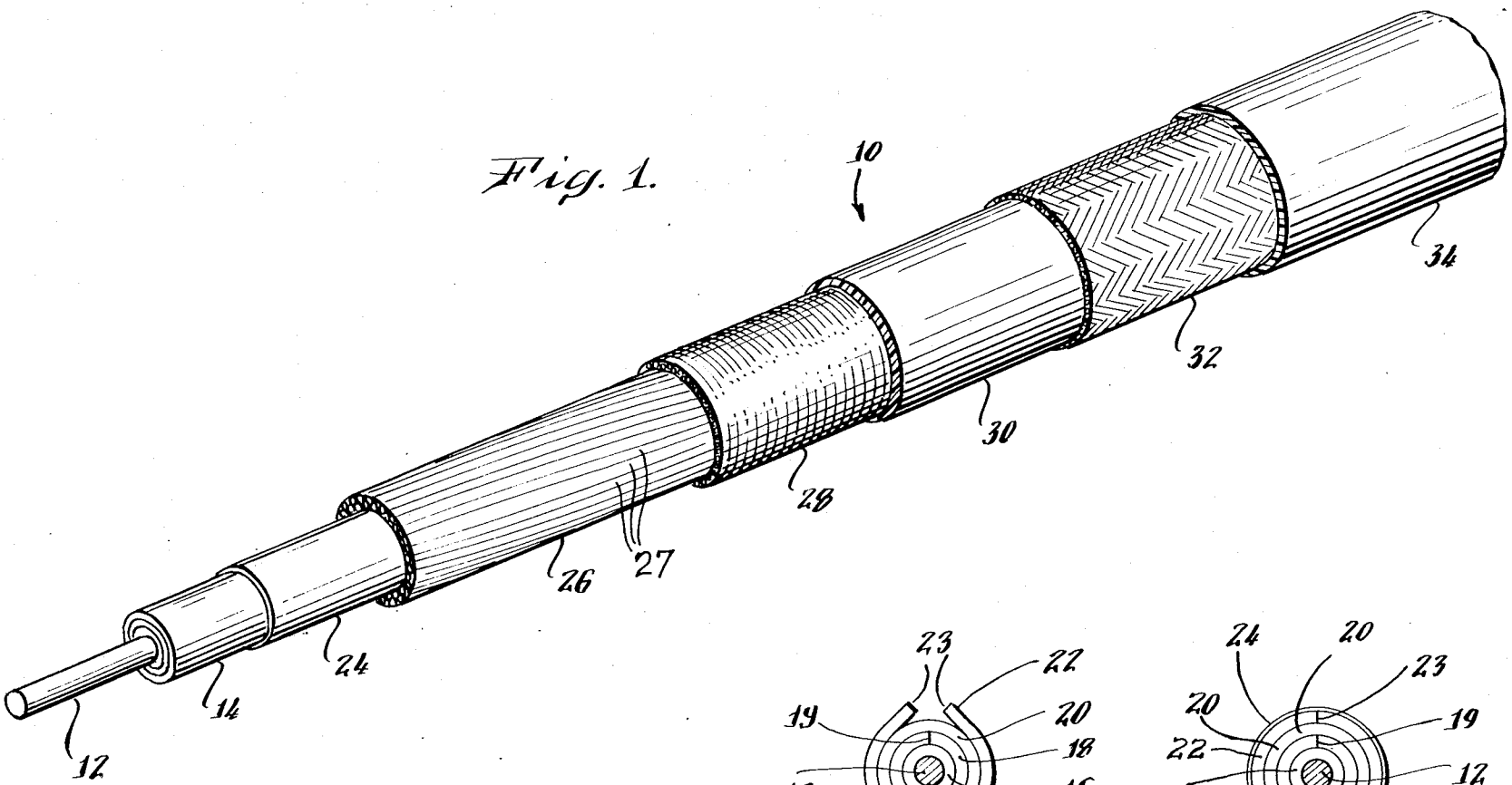
FIG. 1 is a perspective view, greatly enlarged, of a triaxial cable embodying the invention with portions of the cable layers being shown removed in order to more clearly illustrate the construction of the cable.
Figure 2:
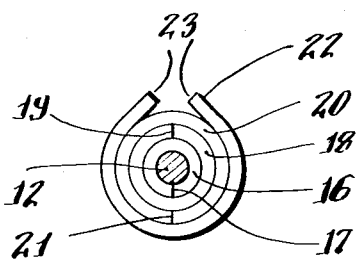
FIG. 2 illustrates a cross-sectional view of the second step of the manufacturing process of the cable illustrating the manner in which the central conductor has the low density PTFE dielectric material wrapped thereon.

Referring now to FIG. 1, a coaxial cable referred to generally with the reference character 10, is provided with a center conductor 12 which is a solid single strand wire preferably of silver-plated copper. The copper itself is preferably of the commercial grade referred to as OFHC (oxygen free high conductivity). The center conductor 12 is surrounded by a flexible cylindrical dielectric material 14 in the form of multiple layers of low density PTFE (polytetrafluorethylene) characterized by having a low density and low dielectric constant, for example, a specific gravity of 0.7 and a dielectric constant of 1.45. The low density PTFE dielectric material 14 extends coaxially with the central conductor 12 and is preferably applied as illustrated in FIG. 2. Multiple layers 16, 18, 20 and 22, of low density PTFE tape are wrapped with their butting edges 17, 19, 20 and 21, respectively, positioned on opposite sides of the central conductor 12 as shown in FIG. 2 with no overlap upon itself of the edges of a given layer. A completely symmetrical uniform layer 14 of low density PTFE dielectric material is distributed along the full length of the central core wire 12 of the cable 10. Utilizing the butted-edge wrap method as illustrated in FIG. 2 advantageously provides a symmetrical dielectric of uniform cross section throughout. This butted-edge avoids the use of the conventional lap wrapping which would result in an asymmetrical application of tape thus causing non-uniform dielectric having varying insulating wall cross sections which would be detrimental to the performance of the cable. In using the butted-edge wrap method for the multiple layers of low density tape, succeeding layers are applied from opposite sides in a manner that enables each succeeding layer to cover the butted-edges of the previous layer for securing all of the preceding layers in position, up to the last layer 22 which remains unsecured as illustrated by its upstanding buttable-edges 23.

The low density tape layers 16, 18, 20 and 22, are unsintered. Each of the low-density layers 16, 18, 20, 22 is relatively thick; for example, each layer has a thickness of 10 mils (0.010 of an inch).

Figure 3:
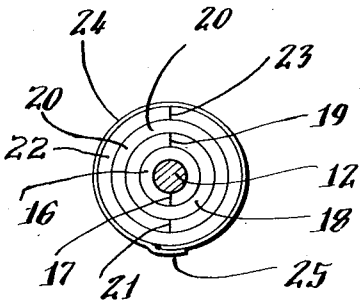
FIG. 3 illustrates the securing or positioning step of holding the low density PTFE material illustrated in FIG. 2 on the core by wrapping an overlapped layer of high density PTFE around the layers of low density material illustrated in FIG. 2.

At this stage, a high density unsintered PTFE tape layer 24 is tightly applied over the low density PTFE material 14 with a slight 5 to 10 mil overlap 25 of its own edges as illustrated in FIG. 3. The overlap 25 is on the opposite side of the core from the butted edges 23 of the outermost low-density tape layer. Pressure is then applied to coldweld the overlap 25, after which the high density tape layer 24 is cured by heating to fuse (to sinter) this thin, embracing, envelope layer 24 of high density dielectric. In this condition, the tape 24 advantageously forms an envelope strong enough to hold the low density dielectric material 14 in position during all of the remaining manufacturing steps and in ultimately preparing the cable 10 to accept a suitable terminating connector.

In other words, the cured (fused) high density PTFE dielectric layer 24 functions to hold and secure the underlying layers 16, 18, 20 and 22 in position to form the low density PTFE dielectric material 14 surrounding the central core conductor 12. The number of 10 mil thick layers of low-density PTFE tape is increased from what is shown, when making cables of larger size. As is apparent from the illustration on FIG. 3 the thickness of the layer 24 of high density tape is considerably less than that of the layers of tape in the low-density dielectric 14. For example, the thickness of the unsintered high density PTFE tape 24 may be on the order of 0.004 of an inch (4 mils), but it may shrink slightly when cured.

The outer conductor or shield 26 is formed of a plurality of conductive small diameter wire strands 27 extending longitudinally along the cable 10. All of these longitudinal conductive elements 27 run parallel, adjacent and are in electrical contact with each other and surround and form the first shield 26 and they have a long lay helical configuration. This helical shield is in the form disclosed and claimed in the aforesaid U.S. Pat. No. 4,408,089. The helical shaped outer conductor 26 for example, may be in the form of 240 strands 27 of 0.004 inch diameter silver-plated OFHC copper wires which extend longitudinally the length of the cable 10 with a slight helical lay. As seen in FIG. 1 there are sufficient of these wire strands 27 for forming at least two full layers completely encircling the high density layer 24.

The conducting elements of the helical shield 26 are firmly held in place around the outside of the dielectric medium formed by low density dielectric material 14 secured by the fused dielectric tape 24, by a continuous uniform tight-fitting retaining wrapping or serving layer 28. The serving 28 is formed of strong, stranded or ribbon insulating material for example, 32 parallel strands of PTFE coated glass yarn wrapped tightly.

This serving 28 in turn is surrounded by an outer jacket 30 of tough, durable, flexible material, for example, in the form of high density PTFE tape applied unsintered and then cured to a thickness of 0.011 of an inch to form the outer jacket 30 of the coaxial cable 10.

After the unsintered tape for forming this outer jacket 30 has been applied, the cable 10 is passed through an 800° F. oven to cure the outer jacket and complete the coaxial portion of the cable. The cable completed to this point will dramatically out perform conventional cables with respect to reduced attenuation loss, reduced radiation loss, and ability to retain consistent, reliable characteristics in spite of being mechanically flexed during operation.

In one embodiment of such a high performance coaxial cable having a nominal surge impedance of 50 ohms the respective components as shown in FIG. 1 had the following respective nominal outside diameters (OD):

EXAMPLE I

| Cable Component: | Nominal O.D. in Mils: |
|---|---|
| Conductor 12 | 51 |
| Low Density Dielectric 14 | 131 |
| High Density Dielectric 24 | 137 |
| Outer Conductor 26 | 153 |
| Retaining Serving Layer 28 | 158 |
| Outer Jacket 30 | 180 |

Although a coaxial cable completed as described above is dramatically improved in performance as compared with conventional coaxial cable, I have found that it can be improved still further. It is my theory for explaining why this further improvement is obtained that the low density PTFE dielectric material 14 expands during curing of the outer jacket 30 in the oven, and the expanded material forces the wires 27 of the helical shield 26 slightly outwardly. Then, when they return from cooling of the dielectric 14, the shield wires 27 of the shield 26 are no longer closely and firmly supported by the underlying low density dielectric 14.

Regardless of whether my theory about the expanding of the low-density dielectric 14 is correct or not, the above-described superior coaxial cable can be improved still further as will now be described.

Accordingly, pursuant to another aspect of this invention, a braided shield 32 is tightly applied over the outer jacket 30 of the cable 10 to apply uniform tightly-embracing, squeezing compression around the strands 27 of the coaxial conductor 26 to force these wires 27 of the helical lay conductor 26 inwardly tightly against each other and tightly against the high-density dielectric layer 24. The application of this braid 32 reduces attenuation loss of the above-described cable including components 12, 14, 24, 26, 28 and 30, down to 35 deciBels per 100 feet from 42 deciBels per 100 feet. The braid 32 comprises, for example, a braid containing 192 strands of 0.004 inch diameter silver-plated OFHC copper wire. For example, this braid 32 includes sixteen braided groups of these wire strands, with each group including twelve wire strands. Another outer jacket 34 is applied over the braid 32. This jacket 34 is in the form of a 10 mil thick high-density PTFE tape, or it an extrusion, or shink tubing utilized to form the outer jacket 34 of the triaxial cable. This final outer jacket 34 is intended to protect the braid 32, and thus the use of shrink tubing or of an extruded plastic material is quite appropriate.

In one embodiment of such a high performance triaxial cable having a norminal surge impedance of 50 ohms the components 12, 14, 24, 26, 28 and 30, had the dimensions as set forth in Example I above, then the remaining components had the following respective nominal outside diameters.

EXAMPLE II

| Cable Component: | Nominal O.D. in Mils: |
|---|---|
| See Example I | See Example I |
| Braid Layer 32 | 198 |
| Final Outer Jacket 34 | 218 |

The use of this additional braid 32 forming the triaxial version of the cable has been found to make a cable considerably more phase stable than the coaxial version without the added braid 32. The electrical length of the triaxial version (in terms of phase) changes no more than 4° even with the abusive handling (sharp U-bend and re-straighten) which compares to a 40° change in the electrical length before adding the second braid 32. This test was made at 18 gigaHertz on a 20 inch long cable assembly, which includes the length of the coaxial or triaxial cable plus the connectors attached at each end.

Figure 4:
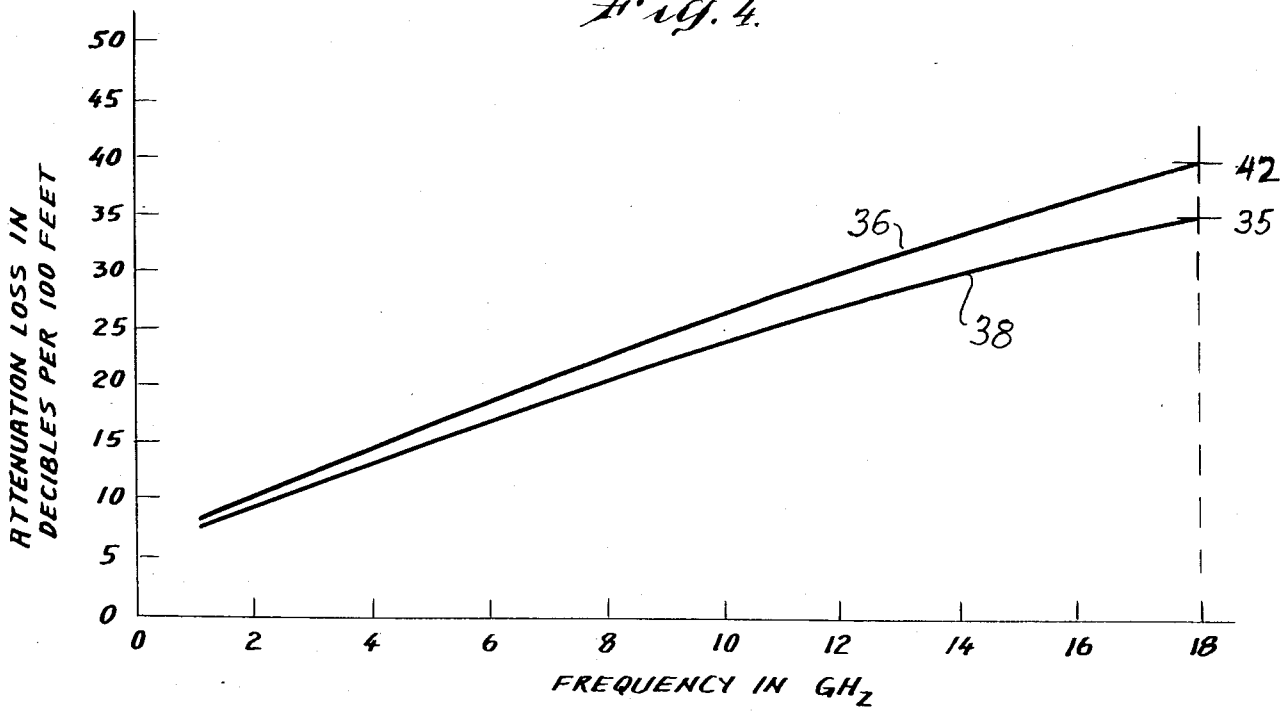
FIG. 4 is a graph of attenuation loss in decibels per 100 feet plotted versus frequency in the GHz range.

Attention is now invited to FIG. 4, which is a graphical plot of attenuation loss in dB per one hundred feet of coaxial cable versus frequency of the microwave energy being transmitted through the cable.

The upper curve 36 shows the performance of the embodiment of the invention in which the braid 32 and the outer jacket 34 are omitted. In other words, this curve 36 shows the performance of the coaxial cable of EXAMPLE I. It is to be noted that this curve 36, with a loss of only 42 dB at 18 gHz, compares very favorably with curve 34 of FIG. 4 of my father's U.S. Pat. No. 4,408,089, in which the loss is 58 dB at 18 gHz.

The lower curve 38 in FIG. 4 shows the performance of the triaxial version in which the braid 32 and outer jacket 34 are included. In other words, curve 38 shows the performance of the coaxial cable (triaxial version) of EXAMPLE II. The loss at 18 gHz has been reduced from 42 dB to 35 dB.

In the optimum embodiment, the serving 28 is omitted when the tight wire braid 32 is to be included. In other words, the uncured high density PTFE material 30 is applied directly over the wire strands 27. Then, this high density material 30 is cured in place by passing the cable through an 800° F. oven. Next, the tight wire braid 32 is applied, and finally the outer jacket 34 is applied. The tight wire braid 32 on top of the cured high density PTFE material 30 tightly holds the strands 27 against one another for producing the improved performance shown by the plot 38 in FIG. 4. The omission of the serving 28 in this triaxial version achieves a reduction in over-all diameter of the finished cable and a reduction in weight per unit foot without causing any perceptible degradation in performance.

This optimum embodiment has the following dimensions:

EXAMPLE III

| Cable Component: | Nominal 0.D. in Mils: |
|---|---|
| Conductor 12 | 51 |
| Low Density Dielectric 14 | 131 |
| High Density Dielectric 24 | 137 |
| Outer Conductor 26 | 153 |
| Jacket 30 | 175 |
| Braid Layer 32 | 193 |
| Final Outer Jacket 34 | 213 |

Accordingly, a coaxial cable (generic sense) has been provided for microwave frequencies in the gigaHertz range which permits the use of a low density dielectric material which improves the attenuation loss characteristics of the cable while permitting connections to be made thereto relatively easily. In addition, with the additional braid a marked improvement in attenuation loss and in phase stability during flexing or bending is achieved in accordance with the present invention.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A low attenuation high frequency coaxial cable for carrying microwave energy in the gigaHertz range and having a center conductor extending along the axis of the cable comprising:

dielectric surrounding said center conductor including a plurality of layers of low density PTFE dielectric tape material, at least one layer of high density PTFE dielectric material of a different dielectric constant than the layers of low density PTFE surrounding and holding said plurality of layers of low density PTFE dielectric material around said center conductor, each of said layers of low density dielectric material comprising a tape extending longitudinally of the cable with its edges abutting in edge-to-edge relationship, the abutting edges of each layer of low density material being located away from the abutting edges of an adjoining layer, and said layer of high density dielectric material comprising a tape of unsintered PTFE material, extending longitudinally of the cable and encircling the underlying low density dielectric layers, and which is sintered in place after being applied over the underlying low density dielectric layers;

a plurality of longitudinally extending, parallel, adjacent conductive wire strands which are in electrical contact with each other forming an outer conductor encircling said high density PTFE dielectric material, said conductive wire strands having a slight helical lay along the axis of said cable, means surrounding and holding said strands in place, and a protective outer jacket surrounding said holding means.

2. The low attenuation coaxial cable as claimed in claim 1, having a tight wire braid around said jacket for applying compressive force around said jacket for pressing the conductive wire strands of said outer conductor inwardly together around said high density PTFE dielectric material of said cable and thereby further reducing the attenuation of said cable.

3. In a low attenuation high frequency coaxial cable for carrying microwave energy in the gigaHertz range having a central conductor and an outer conductor spaced from and concentric with the central conductor and having dielectric in the region between the central and outer conductor, the improvement comprising:

said dielectric comprising an inner portion of low density of PTFE material and an outer portion of high density PTFE material, said inner portion comprising a plurality of layers of low density PTFE material, each of said layers having abutting edges, the abutting edges of each layer being located on the opposite side of the central conductor from the abutting edges of an adjoining layer, and said outer portion comprising at least one layer of high density PTFE material encircling the low density material and with its edges overlapping for holding it firmly in place and being applied in its unsintered state and being sintered in place.

4. In a low attenuation high frequency coaxial cable, the improvement as claimed in claim 3, wherein said outer conductor comprises a plurality of longitudinally extending, parallel, adjacent, conductive wire strands which are in electrical contact with each other, said strands having a slight helical lay along the axis of the cable and being sufficiently numerous to form at least two full layers encircling said high density PTFE material, the further improvement comprising:

a first jacket of high density PTFE applied uncured over said strands and then cured in place by heating, a wire braid tightly surrounding said jacket, and a second jacket surrounding said wire braid.

5. In a low attenuation high frequency coaxial cable, the further improvement as claimed in claim 4, in which:

said wire braid comprises sixteen groups of twelve wires each braided tightly around said first jacket.

6. A low attenuation high frequency coaxial cable for carrying microwave energy in the gigaHertz range and having a center conductor extending along the axis of the cable comprising:

dielectric surrounding said center conductor including at least four layers of low density PTFE dielectric material, having a specific gravity of about 0.7 and a dielectric constant of about 1.45 and each layer is about 10 mils (about 0.010 of an inch) thick, at least one layer of high density PTFE dielectric material having a specific gravity of about 2 and a dielectric constant of about 2.1 surrounding and holding said layers of low density PTFE dielectric material around said center conductor, a plurality of longitudinally extending, parallel, adjacent conductive wire strands which are in electrical contact with each other forming an outer conductor encircling said high density PTFE dielectric material, said conductive wire strands having a slight helical lay along the axis of said cable, means holding said strands in place, and a protective outer jacket surrounding said holding means.

7. The low attenuation coaxial cable as claimed in claim 6, in which:

each layer of high density dielectric material is about 4 mils (about 0.004 of an inch) thick.

8. The low attenuation coaxial cable as claimed in claim 6, having a tight wire braid around said jacket for applying compressive force around said jacket for pressing the conductive wire strands of said outer conductor inwardly together around said high density PTFE dielectric material of said cable and thereby further reducing the attenuation of said cable.

9. The low attenuation coaxial cable as claimed in claim 8, in which:

each layer of high density dielectric material is about 4 mils (about 0.004 of an inch) thick.

10. A low attenuation high frequency coaxial cable for carrying microwave energy in the gigaHertz range and having a center conductor extending along the axis of the cable comprising:

dielectric surrounding said center conductor including a plurality of layers of low density PTFE dielectric material, at least one layer of high density PTFE dielectric material surrounding and holding said plurality of layers of low density PTFE dielectric material around said center conductor, a plurality of longitudinally extending, parallel, adjacent conductive wire strands which are in electrical contact with each other forming an outer conductor encircling said high density PTFE dielectric material, said conductive wire strands having a slight helical lay along the axis of said cable, means holding said strands in place, and a protective outer jacket surrounding said holding means, each of said layers of low density dielectric material comprising a tape extending longitudinally of the cable with its edges abutting in edge-to-edge relationship, the abutting edges of each layer of low density material being located on the opposite side of the center conductor from the abutting edges of an adjoining layer, and said layer of high density dielectric material comprising a tape of unsintered PTFE material extending longitudinally of the cable and encircling the underlying low density dielectric layers and with its edges overlapping and which is sintered in place after being applied over the underlying low density dielectric layers.

11. A low attenuation high frequency coaxial cable for carrying microwave energy in the gigaHertz range and having a center conductor extending along the axis of the cable comprising:

a dielectric surrounding said center conductor including at least four layers of low density PTFE dielectric material, and each layer being about 10 mils (0.010 of an inch) thick, at least one layer of high density PTFE dielectric material surrounding and holding said plurality of layers of low density PTFE dielectric material around said center conductor, a plurality of longitudinally extending, parallel, adjacent conductive wire strands which are in electrical contact with each other forming an outer conductor encircling said high density PTFE dielectric material, said conductive wire strands having a slight helical lay along the axis of said cable, a jacket of uncured high density PTFE material applied over said wire strands and then cured in place, and a tight wire braid around said jacket for applying compressive force around said jacket for pressing the conductive wire strands of said outer conductor inwardly together around said layer of high density PTFE dielectric material of said cable and thereby further reducing the attenuation of said cable.

12. The low attenuation coaxial cable as claimed in claim 11, in which:

the layer of high density dielectric material is about 4 mils (about 0.004 of an inch) thick.

13. The low attenuation coaxial cable as claimed in claim 12, in which:

said low density dielectric material has a specific gravity of about 0.7 and a dielectric constant of about 1.45, and said high density dielectric material has a specific gravity of about 2 and a dielectric constant of about 2.1.

14. A low attenuation coaxial cable as claimed in claim 11, in which:

each of said layers of low density dielectric material comprises a tape extending longitudinally of the cable with its edges abutting in edge-to-edge relationship, the abutting edges of each layer of low density material are located away from the abutting edges of an adjoining layer, and said layer of high density dielectric material comprises a tape of unsintered PTFE material, extending longitudinally of the cable, and encircling the underlying low density dielectric layers, and which is sintered in place after being applied over the underlying low density dielectric layers.

15. The low attenuation coaxial cable as claimed in claim 11, in which:

said low density dielectric material has a specific gravity of about 0.7 and a dielectric constant of about 1.45, and said high density dielectric material has a specific gravity of about 2 and a dielectric constant of about 2.1.

16. The low attenuation coaxial cable as claimed in claim 14, in which:

the abutting edges of each layer of low density material are located on the opposite side of the center conductor from the abutting edges of an adjoining layer, and the edges of the high density dielectric material encircling the underlying low density dielectric layers are overlapping.

17. A low attenuation high frequency coaxial cable for carrying microwave energy in the gigaHertz range and having a center conductor extending along the axis of the cable comprising:

a dielectric surrounding said center conductor including a plurality of layers of low density PTFE dielectric material, at least one layer of high density PTFE dielectric material surrounding and holding said plurality of layers of low density PTFE dielectric material around said center conductor, a plurality of longitudinally extending, parallel, adjacent conductive wire strands which are in electrical contact with each other forming an outer conductor encircling said high density PTFE dielectric material, said conductive wire strands having a slight helical lay along the axis of said cable, a jacket of uncured high density PTFE material applied over said wire strands and then cured in place, a tight wire braid around said jacket for applying compressive force around said jacket for pressing the conductive wire strands of said outer conductor inwardly together around said layer of high density PTFE dielectric material of said cable and thereby further reducing the attenuation of said cable, each of said layers of low density dielectric material comprising a tape extending longitudinally of the cable with its edges abutting in edge-to-edge relationship, the abutting edges of each layer of low density material being located on the opposite side of the center conductor from the abutting edges of an adjoining layer, and said layer of high density dielectric material comprising a tape of unsintered PTFE material, extending longitudinally of the cable and encircling the underlying low density dielectric layers and with its edges overlapping and which is sintered in place after being applied over the underlying low density dielectric layers.

* * * * *